US011440043B2

(12) United States Patent
Moras et al.

(10) Patent No.: US 11,440,043 B2
(45) Date of Patent: Sep. 13, 2022

(54) SYSTEM FOR APPLYING AGENT TO A PLASTIC WEB

(71) Applicants: Wayne J. Moras, Chatham, IL (US); Asmin Patel, Chatham, IL (US)

(72) Inventors: Wayne J. Moras, Chatham, IL (US); Asmin Patel, Chatham, IL (US)

(73) Assignee: REYNOLDS CONSUMER PRODUCTS LLC, Lake Forest, IL (US)

( * ) Notice: Subject to any disclaimer, the term of this patent is extended or adjusted under 35 U.S.C. 154(b) by 0 days.

(21) Appl. No.: 16/777,429

(22) Filed: Jan. 30, 2020

(65) Prior Publication Data

US 2021/0237968 A1 Aug. 5, 2021

(51) Int. Cl.

| | |
|---|---|
| ***B05C 1/08*** | (2006.01) |
| ***B05C 1/10*** | (2006.01) |
| ***B05C 1/00*** | (2006.01) |
| *B65F 1/00* | (2006.01) |
| *B05D 1/28* | (2006.01) |
| *B05D 7/04* | (2006.01) |
| *B05D 7/22* | (2006.01) |

(52) U.S. Cl.

CPC ..... *B05C 1/08* (2013.01); *B05C 1/0808* (2013.01); *B05C 1/0813* (2013.01); *B05C 1/10* (2013.01); *B05C 1/00* (2013.01); *B05C 1/0826* (2013.01); *B05D 1/28* (2013.01); *B05D 7/04* (2013.01); *B05D 7/22* (2013.01); *B65F 1/0026* (2013.01)

(58) Field of Classification Search

CPC ..... B05C 17/025; B05C 1/00; B05C 1/08; B05C 1/06; B05C 1/0813; B05C 1/0821; B05C 1/10; B05C 1/0808; B05C 1/0826; Y10S 118/14; Y10S 118/15; B65F 1/0026; B31B 70/79; B31B 70/74

USPC ..... 118/244, 256, 259, 260, 264, 265, 266, 118/268

See application file for complete search history.

(56) References Cited

U.S. PATENT DOCUMENTS

| | | | |
|---|---|---|---|
| 5,102,384 | A | 4/1992 | Ross et al. |
| 6,488,222 | B1 | 12/2002 | West et al. |
| 9,108,380 | B2 | 8/2015 | Binger et al. |
| 9,745,126 | B1 | 8/2017 | Cobler |
| 10,233,016 | B2 | 3/2019 | Cobler |

(Continued)

FOREIGN PATENT DOCUMENTS

EP 0792696 * 9/1997

OTHER PUBLICATIONS

Written Opinion of the International Preliminary Examining Authority, dated Dec. 10, 2021, filed in PCT/US2021/013553; 11 pages.

*Primary Examiner* — Laura Edwards
(74) *Attorney, Agent, or Firm* — Vedder Price P.C.

(57) ABSTRACT

A system and method for applying a fragrance or malodor control agent to a plastic web is provided. The system includes a form and seal machine that is used to form and seal a plastic web and a fragrance or malodor control agent applicator that applies a fragrance or malodor control agent to the plastic web. The fragrance or malodor control agent applicator designed to apply fragrance or malodor control agent directly to a first interior surface and a second interior surface formed by folding the plastic web with the form and seal machine.

28 Claims, 6 Drawing Sheets

(56) References Cited

U.S. PATENT DOCUMENTS

| | | | | |
|---|---|---|---|---|
| 2006/0045981 | A1* | 3/2006 | Tsushi | B05D 1/26 427/428.01 |
| 2006/0165319 | A1 | 7/2006 | Patridge et al. | |
| 2006/0193985 | A1* | 8/2006 | McNeil | B41F 15/0831 427/355 |
| 2008/0212903 | A1 | 9/2008 | Germanow et al. | |
| 2010/0108775 | A1 | 5/2010 | Donaty | |
| 2011/0245057 | A1 | 10/2011 | Scoledes et al. | |
| 2013/0219827 | A1 | 8/2013 | Pallotta et al. | |
| 2017/0362023 | A1 | 12/2017 | Cobler | |
| 2018/0221907 | A1* | 8/2018 | Alaghband | B05C 1/08 |

* cited by examiner

SYSTEM FOR APPLYING AGENT TO A PLASTIC WEB

FIELD OF THE INVENTION

This invention generally relates to a system and method for applying a fragrance or malodor control agent to a plastic web, and particularly to plastic webs used to manufacture trash bags.

BACKGROUND OF THE INVENTION

Plastic trash bags have long been used to line trash receptacles. The trash bags encourage sanitary conditions by preventing the refuse from contacting the receptacle. Trash bags also provide a convenient way to remove trash from a receptacle for transport or disposal.

As trash often contains food scraps and other malodor producing items there have been many attempts to produce fragrance trash bags to hide the malodors produced by the bag contents.

While it is relatively easy to apply volatile fragrance components directly to malodors in the air, such as fast acting aerosol air sprays that include fragrance freshening composition, it is much more difficult to apply fragrance or malodor control agents directly to plastic trash bags, such that the fragrance or malodor control agent controls the malodor from trash by passively diffusing from the plastic trash bag.

One of the difficulties is that many fragrance and malodor control agents are not soluble in the typical plastic composition of plastic trash bags. Another difficulty is that much of the fragrance and malodor control agents that can be volatilized at ambient temperatures and are substantially volatilized by the high temperatures required during the melt extrusion process of the plastic or other plastics that are used to create the trash bags.

Further, the volatilization of the fragrance and malodor control agents during the production process may also require costly venting and exhaust components to provide venting for the fragrance or malodor component being applied, is wasteful of the costly fragrance and odor control agents, and changes the notes of the fragrance and malodor control agents as the components are differentially volatilized.

The above difficulties are particularly apparent in the production of trash bags, where the bags are relatively large, and the production process is relatively complex. Therefore, a system and method for applying a fragrance to a malodor control agent is needed that is capable of directly applying a fragrance or malodor control agent directly to a sheet of plastic web.

The invention provides such a system and method for applying a fragrance or malodor control agent directly to a plastic web. These and other advantages of the invention, as well as additional inventive features, will be apparent from the description of the invention provided herein.

BRIEF SUMMARY OF THE INVENTION

In one aspect, the invention provides a system for applying a fragrance or malodor control agent to a plastic web. The system including a form and seal machine and a fragrance or malodor control agent application system. The form seal machine includes a plastic web that is pulled adjacent to the malodor control agent application system. The malodor control agent application system comprises a control module, a pump, a storage tank that stores the fragrance or malodor control agent, and an applicator. The applicator may include a spindle that applies the fragrance or malodor control agent to the plastic web as the plastic web is pulled through the form and seal machine.

According to another aspect, the spindle is rotatively connected to a bracket.

According to yet another aspect, a roller is slidably couplable to the spindle.

According to another aspect, the spindle has an internal cavity extending through the body of the spindle in a first direction and weep holes that extend through the body of the spindle in a second direction.

In yet another aspect, the second direction is perpendicular relative to the first direction.

In still yet another aspect, second direction is angled relative to the first direction.

According to another aspect, the bracket has an internal cavity that extends through the bracket and has a first opening on a first side of the bracket and a second opening on a second side of the bracket.

In yet another aspect, the first opening is connected to a pipe and the second opening is connected to the spindle.

According to still yet another aspect, the pipe is connected to a first end of a piece of tubing and the second end of the piece of tubing is connected to an outlet of the pump.

In another aspect, the second opening is fluidly connected to a first internal cavity extending through the spindle in a first direction.

According to yet another aspect, the spindle includes a second internal cavity that is radially extending between the first internal cavity and an exterior surface of the spindle in a second direction.

According to another aspect, the control module is integrated with the pump.

According to yet another aspect, the plastic web is formed from a polyethylene or a blend thereof.

According to still yet another aspect, the malodor control agent application system includes a fluid spreader having a hollow interior capable storing a supply of fragrance or malodor control agent.

According to another aspect, a weep hole is located at the gravitational bottom of the fluid spreader.

According to yet another aspect, one or more bristles extend from the gravitational bottom of the fluid spreader.

According to still yet another aspect, gravity causes the fragrance or malodor control agent to exit the hollow interior through the weep hole where it is directed toward the spindle by the bristles.

According to another aspect, the malodor control agent application system includes a liquid applicator that is fluidly connected to the pump.

According to yet another aspect, the fluid applicator has a first surface that is composed of a liquid absorbing material that is capable of being sufficiently saturated with fluid or malodor control agent.

According to still yet another aspect, the first surface applies the fragrance or malodor control agent to an exterior surface of the spindle.

According to yet another aspect, the spindle extends as a cantilevered extension from the bracket.

In yet another aspect, the invention provides an applicator for applying a fragrance or malodor control agent to a plastic web. The applicator including a bracket, a spindle rotatably connected to the bracket. The bracket has an internal cavity that extends through the bracket where the internal cavity has a first opening that is fluidly connected to a supply of fragrance or malodor control agent and a second opening that is fluidly connected to a first internal cavity that extends through the spindle in a first direction. The first internal cavity is fluidly connected to a second internal cavity that is radially extending between the first internal cavity and an exterior surface of the spindle.

According to another aspect, the second direction is perpendicular relative to the first direction.

According to still yet another aspect, the second direction is angular relative to the first direction.

In another aspect, the spindle extends from the bracket as a cantilevered extension.

According to another aspect, a roller is slidably connected to the spindle.

According to another aspect, an opening in the roller and the second internal cavity in the spindle are at least partially overlapping as the roller is slidably connected to the spindle.

According to still yet another aspect, the roller has an opening along an interior surface of the roller that allows fluid to pass from the interior surface of the roller to an exterior surface of the roller.

According to still yet another aspect, the roller has an exterior surface made from a liquid absorbing material.

According to another aspect, at least a portion of the exterior surface of the spindle is knurled.

According to another aspect, the applicator further includes a fluid spreader having a hollow interior capable storing a supply of fragrance or malodor control agent.

According to another aspect, a weep hole is located at the gravitational bottom of the fluid spreader.

According to another aspect, a bristle is extending from the gravitational bottom of the fluid spreader.

According to another aspect, gravity causes the fragrance or malodor control agent to exit the hollow interior through the weep hole where it is directed toward the spindle by the bristles.

According to another aspect, a liquid applicator is fluidly connected to the pump.

According to another aspect, the fluid applicator has a first surface that is composed of a liquid absorbing material that is capable of being sufficiently saturated with fluid or malodor control agent.

According to another aspect, the first surface applies the fragrance or malodor control agent to an exterior surface of the spindle.

According to another aspect, an external surface of the roller is at least partially composed of a liquid absorbing material.

In another aspect, the invention provides a method for applying a fragrance or malodor control agent to a plastic web. The method comprises folding a plastic web to form a first interior surface and a second interior surface and opening the plastic web with a web opening device to form a gap between the first interior surface and the second interior surface. The method further comprises applying a fragrance or malodor control agent to the first interior surface or the second interior surface with a liquid absorbing material.

According to another aspect, the method includes at least a portion of the liquid absorbing material extending into the gap formed when the fragrance or malodor control agent is applied to the first interior surface or the second interior surface of the plastic web.

According to still yet another aspect, the method includes the liquid absorbing material extending into the gap between 1 inches and 12 inches.

In yet another aspect, the method includes the liquid absorbing material connected to a roller.

According to yet another aspect, the method includes a vertical seal bar creating a first heat seal and a second heat seal on the plastic web.

According to another aspect, the method includes the first heat seal being parallel relative to the second heat seal.

In another aspect, the method includes the second heat seal and the second heat being perpendicular to the gap created by the web opening device.

According to another aspect of the present application, a system for applying a fragrance or malodor control agent to a plastic web is provided. The System further comprising a form and seal machine for moving plastic web through one or more bag forming stations, where one of said bag forming stations creates a web having two facing interior surfaces. The system further comprising a fragrance of malodor control application system comprising a spindle adapted to locate a liquid fragrance or malodor control agent on an exterior surface of the spindle, where at least one of the two facing interior surfaces of the web contact the exterior surface of the spindle as the plastic web is moved through the form and seal machine, and where the liquid fragrance or malodor agent is applied to the at least one of the two facing interior surfaces of the web via contact with the exterior surface of the spindle having the liquid fragrance or malodor control agent located thereon.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
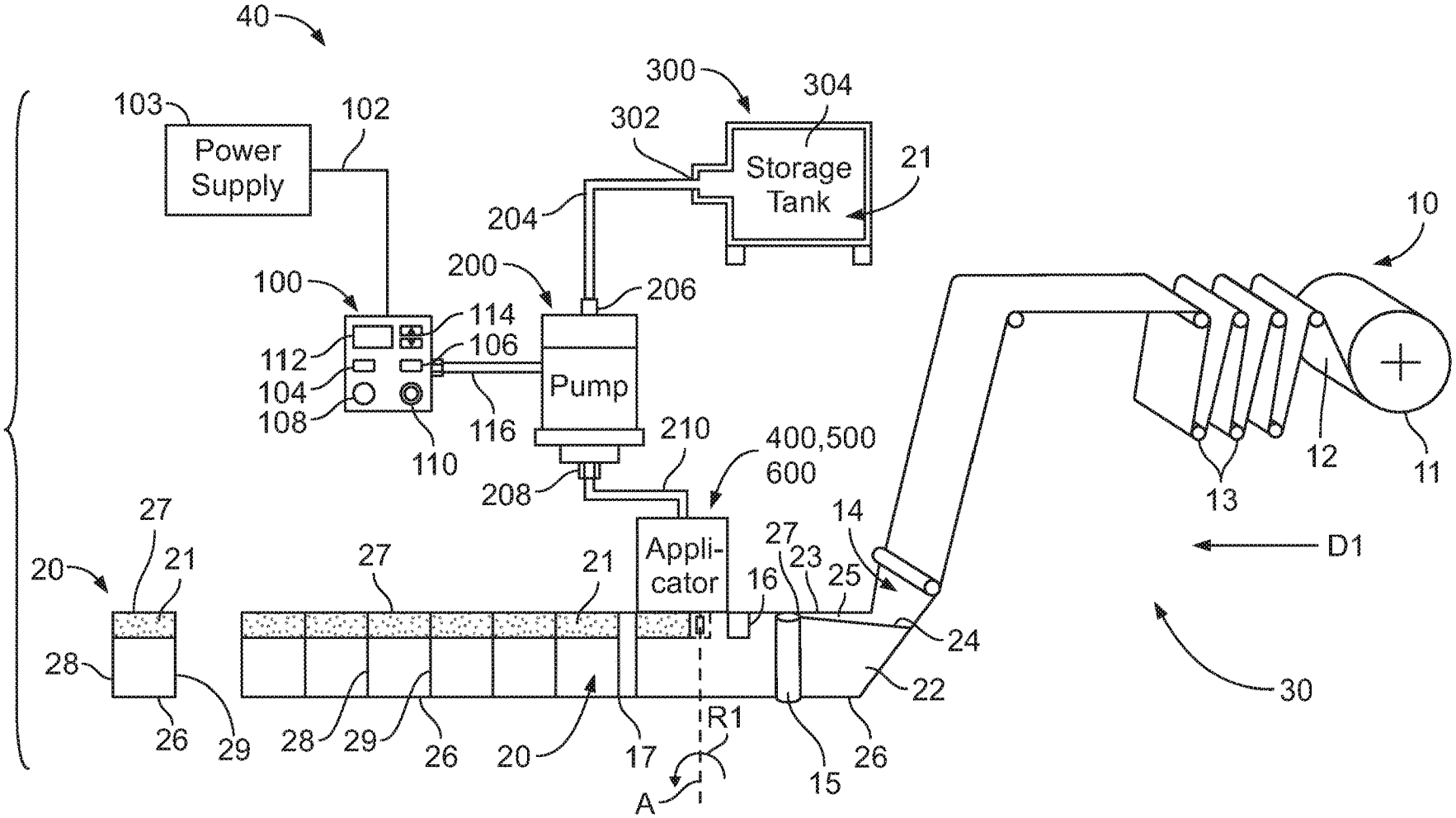
FIG. 1 illustrates one system for applying a fragrance or malodor control agent to a plastic web according to one aspect of the present application.

FIG. 1 illustrates a system 10 for manufacturing a trash bag 20 having a fragrance or malodor control agent 21. As illustrated, the system 10 generally includes a form and seal machine 30 that is used to form and seal the trash bag 20 and a fragrance or malodor control agent application system 40 that applies a fragrance or a malodor agent 21 to the trash bag 20. Suitable fragrance or malodor control agents 21 include malodor agents described in U.S. Pat. No. 8,012,554, whose entirety is incorporated herein by reference.

Rotatably attached to a first end of the form and seal machine 30 is a plastic web roll 11 that is made from a sheet of rolled plastic web 12 that is typically a polyethylene web or blends thereof. As will be understood, the form and seal machine 30 may include multiple operating stations for forming and sealing a plastic bag having a bottom, side walls, and opening, as is generally known in the art. Alternatively, a bag making process may be done in-line with the film extruder, which would not require a separate roll 11.

In use, the plastic web 12 is pulled through the form and seal machine 30 in direction D1. As will be understood, the form and seal machine 30 form and seals the unprocessed plastic web 12 into the shape, size, and type of trash bag 20 desired by a user.

The plastic web 12 is first fed through a series of tensioners 13 that act to keep the plastic web 12 taut as it fed through the form and seal machine 30 in direction D1. Next, the plastic web is fed through a v-board 14 of the form and seal machine 30 that is positioned downstream in direction D1 from the tensioners 13. As will be understood, the v-board 14 folds the plastic web 12 as the plastic web 12 is fed through the v-board 14 in direction D1. In alternative embodiments, a plastic web could be presented as a pre-folded web without the need for v-board 14

In the illustrated embodiment of the form and seal machine 30, the v-board 14 folds the plastic web 12 in half, such that the folded plastic web 12 has a first exterior surface 22, a second exterior surface 23, a first interior surface 24, and a second interior surface 25. As also illustrated, the v-board 14 folds the plastic web 12 so that the now folded plastic web 12 has a first or closed end 26 formed at the folding point of the plastic web 12 and a second or open end 27 formed by the opposite edges of the folded plastic web 12.

After the plastic web 12 is folded by the v-board 14, it continues in direction D1 along the form and seal machine 30 until it is fed through a pair of rollers 15 that are designed to flatten and tighten the now folded plastic web 12.

After being fed through the pair of rollers 15, the folded plastic web 12 continues to be fed in direction D1 toward a web opening device 16. The web opening device 16 opens the folded plastic web 12 along the second or open end 27 to provide a gap between the first interior surface 24 and the second interior surface 25 of the folded plastic web 12.

After the gap between the first interior surface 24 and the second interior surface 25 is created by the web opening device 16, the plastic web 12 continues along the form and seal machine 30 in direction D1 towards a fragrance or malodor control agent applicator 400, 500, 600 (hereinafter "applicator"). The applicator 400, 500, 600 applies the fragrance or malodor control agent 21 that is in a liquid form to the first interior surface 24 and/or the second interior surface 25 of the folded plastic web 14 as the folded plastic web 12 passes adjacent to and comes into at least partial contact with the applicator 400, 500, 600 in direction D1.

After the applicator 400, 500, 600 has applied the fragrance or malodor control agent 21 to the folded plastic web 12, the folded plastic web 12 is fed in direction D1 until it reaches a seal bar 17. In the illustrated embodiment, the seal bar 17 is a vertical heat seal bar that can be actuated to stamp the folded plastic web 12 in order to create heat seals 28, 29 between the two folded sides of the plastic web 12. As also illustrated, the heat seals 28, 29 formed by the seal bar 17 will be generally parallel to one another and will run between the first or closed end 26 and the second or open end 27 of the folded plastic web 12. In alternative embodiments, seal bars could be mounted on a rotary drum. Rotary drum machines are well known, and a detailed description may be found in U.S. Pat. Nos. 6,117,058, 4,934,993, 5,518,559, 5,587,032 and 4,642,084 (each of which is hereby incorporated by reference).

According to one aspect of the present application, the seal bar 17 will be programmed to stamp the plastic web 12 at specific time intervals. As will be appreciated, by programming the seal bar 17 to stamp the plastic web 12 at specific time intervals, a user can adjust the distance between the first heat seal 28 and the second heat seal 29 by either increasing the time interval between stampings or by adjusting the speed that the plastic web 12 is being pulled through the form and seal machine 30.

As the seal bar 17 stamps the plastic web 12 it forms a first heat seal 28 and a second heat 29 between the first interior surface 24 and the second interior surface 25 of the plastic web 12. In the illustrated embodiment, the seal bar 17 is also designed to cut the plastic web 12 on the outermost exterior of the first heat seal 28 and the second heat seal 29, such that the portion of the plastic web 12 between the first heat seal 28 and the second heat seal 29 becomes separated from the rest of the plastic web 12.

According to another aspect of the present application, it is envisioned that the seal bar 17 will be designed to form perforations in the plastic web 12 on the outermost exterior of the first heat seal 28 and the second heat seal 29, such that outermost portions of the first heat seal 28 and the second heat seal 29 can be easily tom from the adjacent sections of the plastic web 12.

According to still yet another aspect of the present application, is envisioned that the form and seal machine 30 will include more than one seal bar 17, such that the plastic web 12 can be stamped at multiple locations or at multiple angles by the seal bars 17 as the plastic web 12 is pulled through the form and seal machine 30.

According to still yet another aspect of the present application, it is envisioned that the form and seal machine 30 may include seal bars 17 that are positioned to stamp the plastic web 12 horizontally or diagonally as the plastic web 12 is pulled through the form and seal machine 30 in direction D1.

As will be understood, in the finished trash bag 20 the first heat seal 28 will form the first side of the trash bag 20 and the second heat seal 29 will form the second side of the trash bag 20. As will also be understood, the bottom of the trash bag 20 is formed when the plastic web 12 is folded by the v-board 14 to form the first or closed end 26 of the plastic web 12 and the top of the trash bag 20 is formed by the second or open end 27 formed when folding the plastic web 12 with the v-board 14. Alternatively, as discussed above, the film may be provided already c-folded without the need for v-board 14.

Thus, the finished trash bag 20 includes a portion of the plastic web 12 that has been folded and sealed by the form and seal machine 30, such that that trash bag 20 has three closed sections 26, 28, 29 and one open section 27 with a fragrance or malodor control agent 21 that has been applied to the first interior surface 24 and/or second interior surface 25 at a position adjacent to the open section 27 of the trash bag 20.

In use, a user will place trash and other refuse into the open section 27 of the trash bag 20 where it will be collected and contained by the three closed sections 26, 28, 29 of the trash bag 20. In addition, the fragrance or malodor control agent 21 that has been applied to the first interior surface 24 and/or second interior surface 25 will effectively mask or diffuse any smells from the trash or refuse collected and contained in the trash bag 20.

Next, turning to the fragrance or malodor control agent application system 40 illustrated in FIG. 1. The fragrance or malodor control agent application system 40 generally includes a controller 100, a pump 200, a reservoir or storage tank 300, and a fragrance or malodor control agent applicator 400, 500, 600 (hereinafter "applicator").

The controller 100 includes an electrical connector 102 connected to an electrical power supply 103 that provides electrical energy to power the controller 100. The controller 100 includes controls, such as, but not limited to, a run button 104 and a stop button 106, that when pressed send an electrical signal to turn on or turn off the pump 200. The controller 100 also includes control buttons 108, 110 adjustable to control the output characteristics of the pump 200, such as, but not limited to, the amount of fragrance or malodor control agent 21 being pumped by the pump 200 over a specific time interval, the pressure that the fragrance or malodor control agent 21 is being pumped by the pump 200, etc.

The controller 100 may also include an electronic display 112 and scrolling buttons 114 that allow a user to scroll through information and options that are being displayed by the electronic display 112. The controller 100 also has an output 116 that is electrically connected to the pump 200, such that the controller 100 can transmit signals to the pump 200 to control the operation and output of the fragrance or malodor control agent 21 provided by the pump 200.

As will be understood, the pump 200 can be any type of pump generally known in the art capable of pumping a fluid.

The pump 200 is connected via tube 204 to the storage tank 300 that stores the fragrance and malodor control agent 21. A first end of the tubing 204 is connected to an inlet 206 of the pump 200 and the second end of the tube 204 is connected to an outlet 302 of the storage tank 300 that is fluidly connected to an internal cavity 304 of the storage tank 300 that stores the fragrance and malodor control agent 21 to be pumped by the pump 200.

The pump 200 is also connected to the applicator 400, 500, 600 via a second tube 210. A first end of the second tube 210 is connected to an outlet 208 of the pump 200 and a second end of the second tube 210 is connected to an applicator 400, 500, 600.

According to another aspect of the present application, it is envisioned that the pump 200 will include a controller 100 built directly into the pump 200, such that the separate controller 100 may be eliminated from the system 10 illustrated in FIG. 1.

Figure 2A:
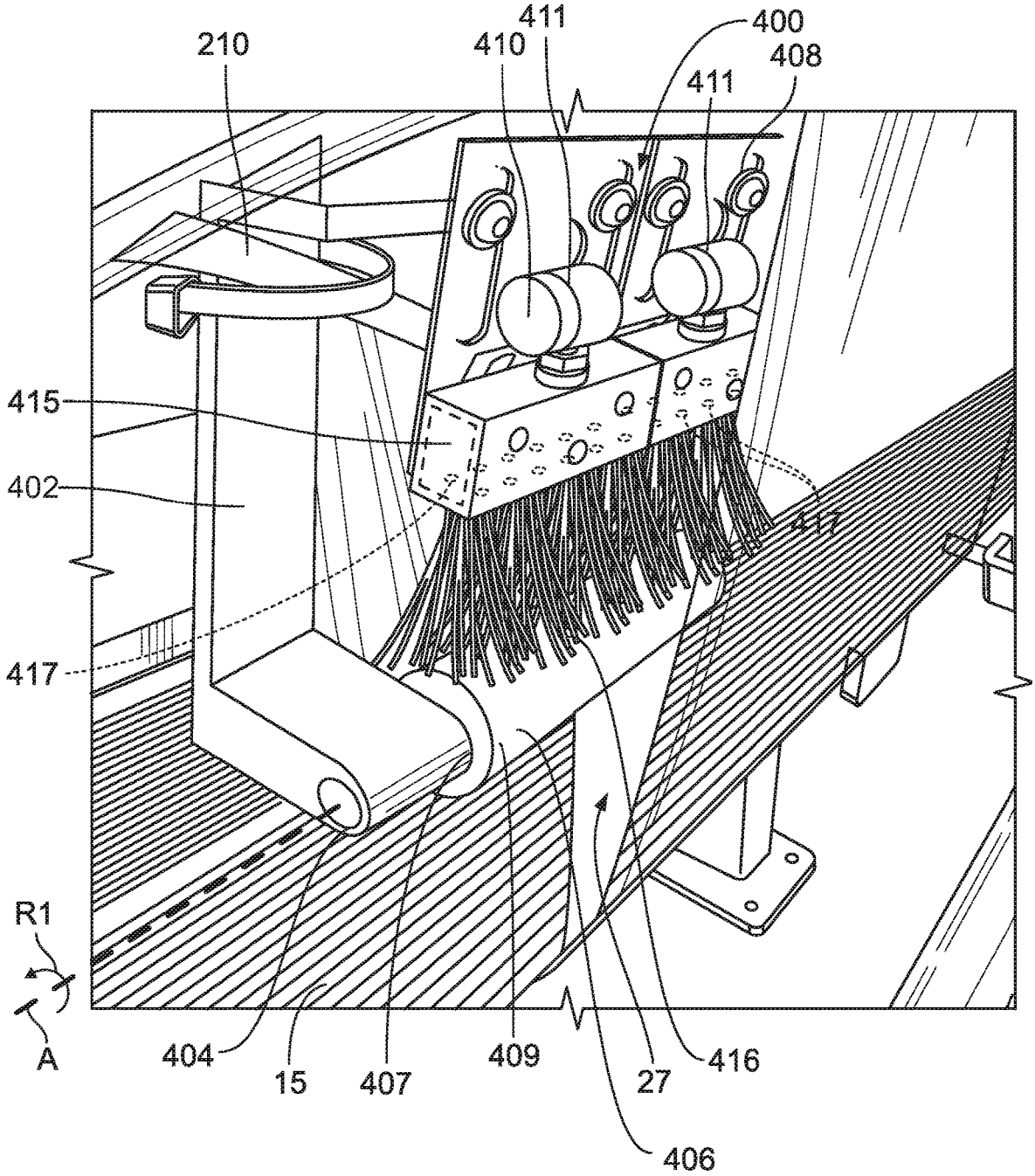
FIG. 2A illustrates a close up view of a fragrance or malodor control agent applicator according to one aspect of the present application that can be used with the system illustrated in FIG. 1.
Figure 2B:
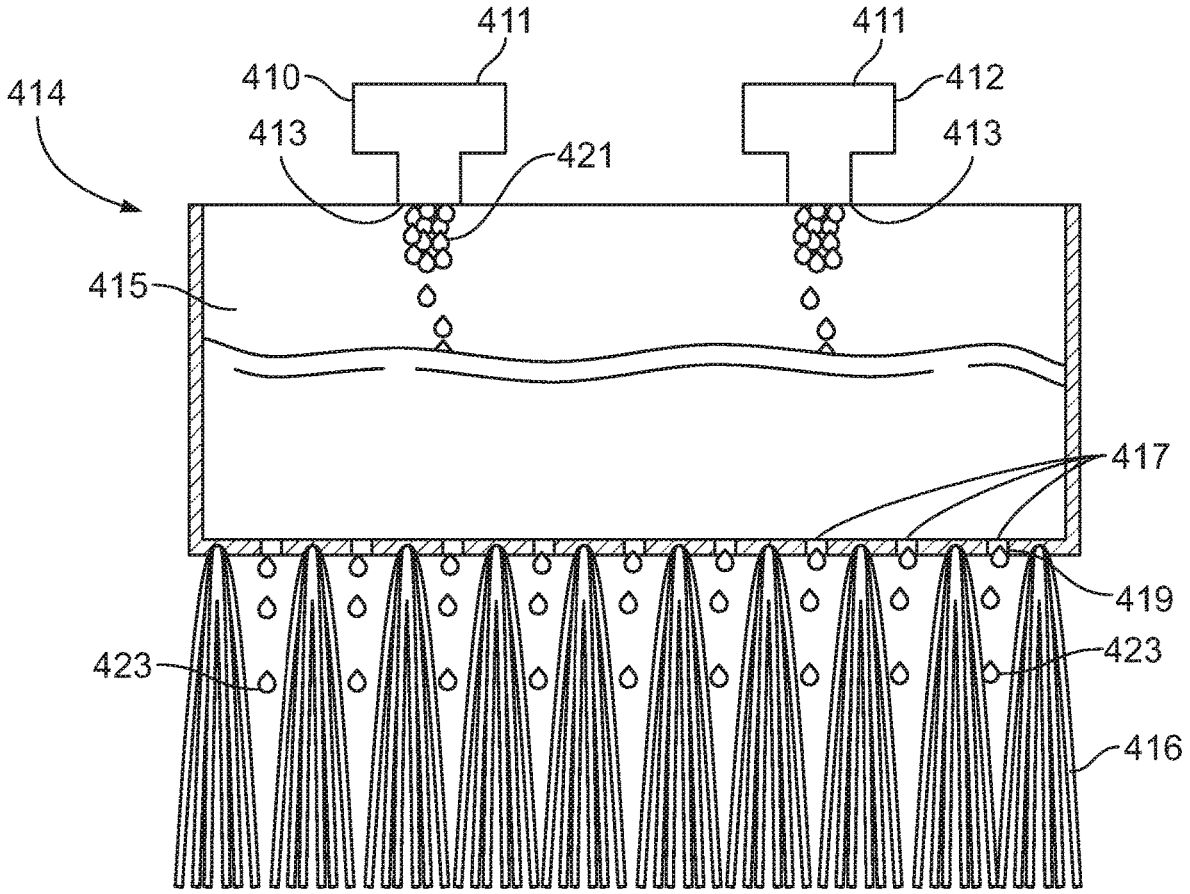
FIG. 2B illustrates a close up cross-sectional view of the fragrance or malodor control agent applicator illustrated in FIG. 2A.

FIGS. 2A & 2B illustrates one example of an applicator 400 according to one aspect of the present invention. The applicator 400 includes a bracket 402 and a spindle 404 that is rotatively connected to the bracket 402 about axis A. The spindle 404 can be made from any material generally known in the art, such as, but not limited to a metal.

According to one aspect of the present application, the fragrance or malodor control agent 21 will be applied to the plastic web 12 by the exterior surface of the spindle 404.

Figure 3A:
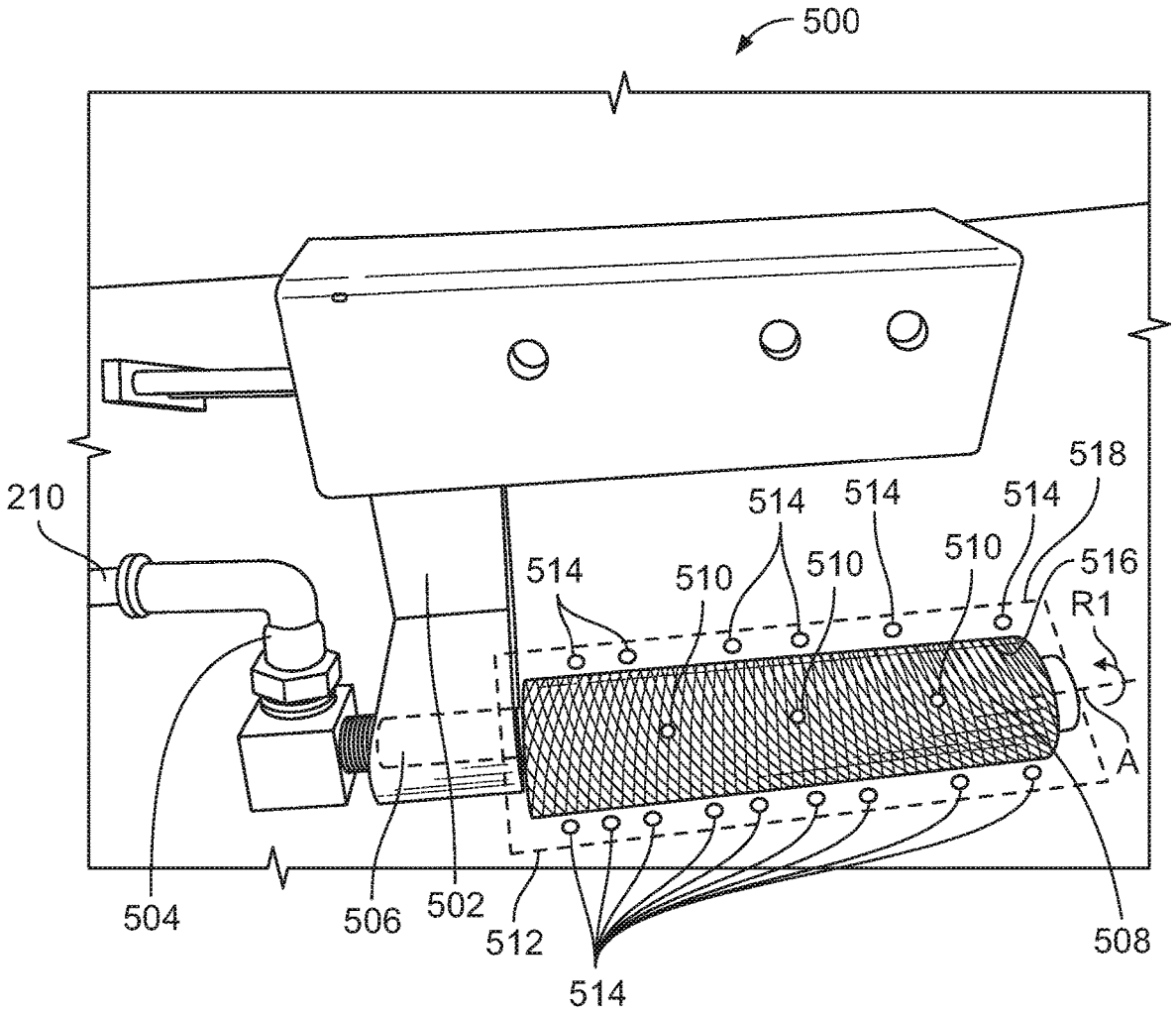
FIG. 3A illustrates a close up view of another embodiment of a fragrance or malodor control agent applicator according to one aspect of the present application that can be used with the system of FIG. 1.

According to another aspect of the present application, at least part of the exterior surface of the spindle 404 will be knurled, such as the knurled surface of spindle 508 illustrated in FIG. 3A. As will be understood, knurling the exterior surface of the spindle 404 allows the fragrance or malodor control agent 21 to be evenly distributed about the exterior surface of the spindle 404.

The applicator 400 also may be fitted with a roller 406 that has an internal surface 407 and an external surface 409. As will be understood, the internal surface 407 of the roller 406 is slidably couplable with the spindle 404, such that the roller 406 is rotatable about axis A when the roller 406 is slidably connected with the spindle 404.

The external surface 409 of the roller 406 will be at least partially composed of a liquid absorbing material. The liquid absorbing material that makes up at least part of the external surface 409 of the roller 406 may be any type of material capable of absorbing a liquid that is generally known in the art such, as but, not limited to a wool, a synthetic fabric, a foam, a foam rubber, a polyester fabric, a polyacrylic woven fabric, a structures polyamide and Nylon, a Nylon woven fabric, or a polyacrylic fabric.

Turning to FIG. 2B, applicator 400 also includes an extruder 408 that includes a first fluid extruder 410 and a second fluid extruder 412. The first fluid extruder 410 and the second fluid extruder 412 have inlet openings 411 that are couplable with tube 210 that extends between the applicator 400 and the pump 200 (see FIG. 1). The first fluid extruder 410 and the second fluid extruder 412 also have outlet openings 413 that are connected with a fluid spreader 414. The fluid spreader 414 has a hollow interior 415 that the outlet openings 413 of the first fluid extruder 410 and the second fluid extruder 412 are fluidly connected to, such that fragrance or malodor control agent 21 can flow 421 into the hollow interior 415 of the fluid spreader 414.

As illustrated, the hollow interior 415 of the fluid spreader 414 provides a reservoir or space where the fragrance or malodor control agent 21 can collect and spread out along the gravitational bottom of the fluid spreader 414.

Also located at the gravitational bottom of the fluid spreader 414 are weep holes 417 that provide a means for the fragrance or malodor control agent 21 to exit from the hollow interior 415 of the fluid spreader 414.

As illustrated, some or all of the weep holes 417 may include a chamfered portion 419 that can provide specific flow characteristics of the fragrance or malodor control agent 21 as it exits the weep holes 417 with the chamfered portion 419.

As will be understood, alternative embodiments may have weep holes 417 that have any size or shape required to provide sufficient amounts of fragrance or malodor control agent 21 to the exterior surface of the spindle 404 or the external surface of the roller 406.

As will also be understood, alternative embodiments may also have any number of weep holes 417 required to provide sufficient amounts or a specific flow of fragrance or malodor control agent 21 to the exterior surface of the spindle 404 or the external surface of the roller 406.

In the illustrated embodiment, the fragrance or malodor control agent 21 is shown exiting from the weep holes 417 in the form of droplets 423 made from fragrance or malodor control agent 21.

According to another aspect of the present application, it is envisioned that the fragrance or malodor control agent 21 may exit from the weep holes 417 under a greater pressure, such that the fragrance or malodor control agent 21 will form a stream when exiting the weep holes 417.

According to still yet another aspect of the present application, it is envisioned that the fragrance or malodor control agent 21 may exit from the weep holes 417 under a lesser pressure, such that the fragrance or malodor control agent 21 will form a mist as the fragrance or malodor control agent 21 exits the weep holes 417.

As will be appreciated, once the fragrance or malodor control agent 21 exits the hollow interior 415 of the fluid spreader 415 via weep holes 417, the fragrance or malodor control agent 21 is pulled downward via gravity toward the exterior surface of the spindle 404 or, alternatively, the roller 406. As will also be appreciated, as the fragrance or malodor control agent 21 is pulled downward toward the roller 406 via gravity the brush bristles 416 that are extending from the gravitational bottom of the fluid spreader 414 will act to guide the fragrance or malodor control agent 21 towards the exterior surface of the spindle 404 or, alternatively, the external surface 409 of the roller 406.

According to one aspect of the present application, the exterior surface of the spindle 404 or the external surface 409 of the roller 406 can be positioned adjacent to or even in contact with at least some of the brush bristles 416 so that when the fragrance or malodor control agent 21 reaches the tips of the brush bristles 416 then the fragrance or malodor control agent 21 will either drop onto the spindle 404 or drop onto and be absorbed directly by the external surface 409 of the roller 406 as the spindle 404 or roller 406 rotates about axis A in direction R1.

After the fragrance or malodor control agent 21 has been applied to the exterior surface of the spindle 404 or the external surface 409 of the roller 406, the exterior surface of the spindle 404 or the external surface 409 of the roller 406 will make contact with first interior surface 24, and a second interior surface 25 of the folded plastic web 12 (see FIG. 1) as the plastic web 12 is being pulled through the form and seal machine 30 in direction D1.

As will be appreciated, the contact made between the exterior surface of the spindle 404 or the external surface 409 of the roller 406 and the first interior surface 24 and the second interior surface 25 of the folded plastic web 12 will cause at least some of the fragrance or malodor control agent 21 applied to the exterior surface of the spindle 404 or the external surface 409 of the roller 406 to pass onto the first interior surface 24 and the second interior surface of the plastic web 12 as the plastic web 12 is pulled through the form and seal machine 30.

As will be understood, as the first interior surface 24 and the second interior surface 25 of the plastic web 12 make contact with the exterior surface of the spindle 404 or the external surface 409 of the roller 406 during the fragrance or malodor agent 21 application process it causes the first interior surface 24 and the second interior surface 25 to exert a frictional force on the spindle 404 or the roller 406 in direction D1 as the plastic web 12 is pulled through the form and seal machine 30 in direction D1. As will be appreciated, the force exerted by the frictional contact made between the first interior surface 24 and the second interior surface 25 of the plastic web 12 and the exterior surface of the spindle 404 or the external surface 409 of the roller 406 causes the spindle 404 or the spindle 404 and roller 406 that is slidably connected to the spindle 404 to rotate about axis A in direction R1.

Therefore, as will be appreciated, neither the spindle 404 nor the roller 406 is required to be provided with a means to rotate about axis A in direction R1. However, it is envisioned that an embodiment of the present invention may be provided with an independent means of rotation, such as a motor, such that the speed of the spindle 404 or the speed of the roller 406 may be controlled, or, such as if the spindle 404 or the roller 406 is only needed to rotate at certain times or when it is making contact with certain sections of the plastic web 12.

Figure 3B:
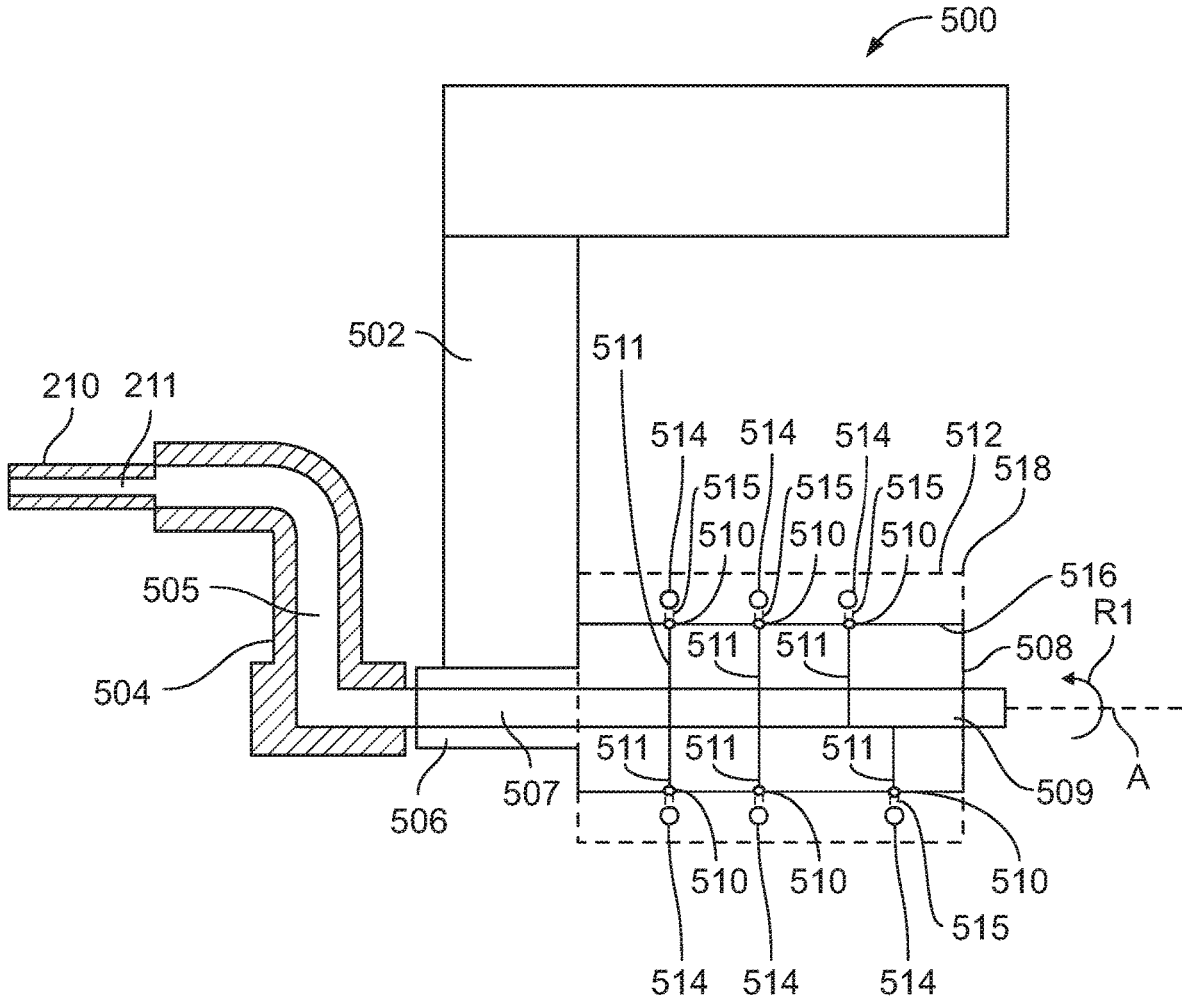
FIG. 3B illustrates a close up cross-sectional view of the embodiment of the fragrance or malodor control agent applicator illustrated in FIG. 3A.

Turning to FIGS. 3A-3B illustrating another example of an applicator 500 according to another aspect of the present application. The applicator 500 includes a bracket 502 that can be positioned adjacent to the form and seal machine 30. The applicator 500 also includes piping 504 that is connected to an opening 506 extending through the body of the bracket 504 and a tube 210 that extends between the pump 200 and the applicator 500.

Connected to the second side of the opening 506 extending through the bracket 502 is a hollow spindle 508. The spindle 508 can be made from any material generally known in the art, such as, but not limited to a metal. The interior of the spindle 508 is rotatively connected to the bracket 502 via the opening 506, such that the spindle 508 is rotatable about axis A. The spindle 508 is also fluidly connected to the bracket 502 via opening 506, such that fragrance or malodor control agent 21 can flow through the opening 510 of the bracket 502 and into the internal cavity 509 of the spindle 504 (see FIG. 3B).

According to one aspect of the present application, the fragrance or malodor control agent 21 will be applied to the plastic web 12 by the exterior surface of the spindle 404. As illustrated, the exterior surface of the spindle 404 is knurled to allow the fragrance or malodor control agent 21 to be evenly distributed about the exterior surface of the spindle 508 for even application of the fragrance or malodor control agent 21. According to another aspect of the present application, a roller 512 can be slidably connected to the exterior surface of the spindle 508. The roller 512 includes weep holes 514 that allow fluid to pass between the internal surface 516 of the roller 512 and the external surface 518 of the roller 512.

FIG. 3B illustrates a cross-sectional view of the applicator 500 shown in FIG. 3A. As illustrated, the tubing 210 running between the pump 200 and the applicator 500 is connected with piping 504 that is connected to the bracket 502 of the applicator 500. The piping 504 has an internal cavity 505 that allows fluid to pass from the tubing 210 and into the internal cavity 505 of the piping 504.

Next, the piping 504 is connected to the bracket 502 at one end of the opening 506 that extends through the body of the bracket 502. The opening 506 has an internal cavity 507 that allows fluid to flow from the internal cavity 505 of the piping 504 into the internal cavity 507 of the opening 506 in the bracket 502.

The spindle 508 has a first internal cavity 509 that fluidly connects to the opening 506 of the bracket 502 when the spindle 508 is rotatably connected to the opening 506 in the bracket 502. The spindle 508 also has a second series of internal cavities 511 that are perpendicular to the first internal cavity 509 of the spindle 508, such that the second series of internal cavities 511 radially extend through the body of the spindle 508 where they terminate on the external surface of the spindle 508 to form weep holes 510.

As will be understood, the weep holes 510 of the spindle 508 can be any size or shape required to provide sufficient amounts of fragrance or malodor control agent 21 to the exterior surface of the spindle 508 or the external surface of the roller 512.

As will also be understood, the spindle 508 can have any number of weep holes 510 required to provide sufficient amounts or a specific flow of fragrance or malodor control agent 21 to the exterior surface of the spindle 508 or, if a roller 512 is slidably connected to the spindle 508, the external surface of the roller 512.

In use, the pump 200 will pump fragrance or malodor agent 21 to the applicator 500 via the internal cavity 211 of the tube 210. The fragrance or malodor agent 21 will then flow from the internal cavity 211 of the tube 210 into the internal cavity 505 of the piping 504. The fragrance or malodor agent 21 will then flow through the internal cavity 507 of the opening 506 formed in the body of the bracket 502 and into the internal cavity 509 of the spindle 508.

The pump 200 will continue to pump fragrance or malodor control agent 21 into the internal cavity 509 of the spindle 508 until sufficient pressure is built up within the internal cavity 509 of the spindle 508 or the centrifugal force caused by the rotation of the spindle 508 causes the fragrance or malodor agent 21 to begin to radially flow through the body of the spindle 508 via the second series of internal cavities 511. When enough fragrance or malodor control agent 21 has been pumped into the spindle 508 by the pump 200 the fragrance or malodor control agent 21 will begin to exit the spindle via the weep holes 510 located along the exterior surface of the spindle 508.

If a roller 512 is not slidably coupled to the exterior surface of the spindle 508, the fragrance or malodor control agent 21 will exit through the weep holes 510 of the spindle 508 where it will begin to spread over the exterior surface of the spindle 508. As will be understood, knurling the exterior surface of the spindle 508 provides a means to ensure that the fragrance or malodor control agent that is exiting the weep holes 510 is evenly distributed about the exterior surfaced of the spindle 508.

If a roller 508 is slidably coupled to the exterior surface of the spindle 508, the fragrance or malodor agent 21 will exit through the weep holes 510 of the spindle 508 and flow through the openings 515 provided in the internal surface 516 of the roller 512 and come into contact with the liquid absorbing material that extends between the internal surface 516 and the external surface 518 of the roller 512.

As will be understood, the liquid absorbing material of the roller 512 discussed herein may be any type of material capable of absorbing liquid that is generally known in the art such, as but, not limited to a wool, a synthetic fabric, a foam, a foam rubber, a polyester fabric, a polyacrylic woven fabric, a structures polyamide and Nylon, a Nylon woven fabric, or a polyacrylic fabric.

According to one aspect of the present application, the roller 512 can be designed to include openings 515 the allow fragrance or malodor control agent 21 to flow between the entire internal surface 516 of the roller 512.

According to another aspect of the present application, the roller 512 can be designed to include openings 515 that allow fragrance or malodor control agent 21 to flow through only specific sections of the internal surface 516 of the roller 512.

The fragrance or malodor control agent 21 will continuously flow through the openings 515 in the internal surface 516 of the roller 512 until the liquid absorbing material located about the exterior surface 518 of the roller 512 becomes sufficiently saturated with fragrance or malodor control agent 21.

As will also be understood, in use, the pump 200 can be set to continuously pump enough fragrance or malodor control agent 21 to the applicator 500 so that the exterior surface of the spindle 508 or the liquid absorbing material located about the exterior surface 518 of the roller 512 are continuously replenished with enough fragrance or malodor control agent 21 to, such that sufficient amounts of fragrance or malodor control agent 21 is being transferred from the exterior surface of the spindle 508 or the liquid absorbing material of the roller 512 to the plastic web 12.

The applicator 500 will be positioned along the form and seal machine 30 so that when the plastic web 12 reaches the location of the applicator 500 along the form and seal machine 30 the plastic web 12 the web opening device 16 will have created an opening 27 that allows the spindle 508 or the roller 512 to pass between and make at least partial contact with the first interior surface 24 and the second interior surface 25 of the plastic web 12 (see FIG. 1).

As will be understood, as the first interior surface 24 and the second interior surface 25 of the plastic web 12 pass over and make at least partial contact with the exterior surface of the spindle 508 or the exterior surface 518 of the roller 512 at least some of the fragrance or malodor control agent 21 that has reached the exterior surface of the spindle 508 or saturated the liquid absorbing material on the exterior surface of the roller 512 will pass from the exterior surface of the spindle 508 or the exterior surface 518 of the roller 512 to the first interior surface 24 and the second interior surface 25 of the plastic web 12.

According to one aspect of the present application, the spindle 508 or the roller 512 will extend into the opening 27 of the folded plastic web 12 so that spindle or the roller 512 applies fragrance or malodor control agent 21 to the first twelve inches of the first interior surface 24 and the second interior surface 25 of the plastic web 12.

As discussed above, as the first interior surface 24 and the second interior surface 25 of the plastic web 12 come into at least partial contact with exterior surface of the spindle 508 or the external surface 518 of the roller 512 at least some of the axial force created by pulling the plastic web 12 through the form and seal machine 30 in direction D1 will be transferred to the spindle 508 or the roller 512, which will cause the spindle 508 or spindle 508 and roller 512 to rotate in direction R1 about axis A.

As will be appreciated, this rotation of the spindle 508 or the spindle 508 and roller 512 in direction R1 also allows the portions of the exterior surface of the spindle 508 or the external surface 518 of the roller 512 that just applied fragrance or malodor control agent 21 to a portion of the first interior surface 24 and a portion of the second interior surface 25 to be replenished with fragrance or malodor control agent 21 before those portions of the exterior surface of the spindle 508 or the external surface 518 of the roller 512 come into contact with another portion of the first interior surface 24 and another portion of the second interior surface 25 of the plastic web 12.

Figure 3C:
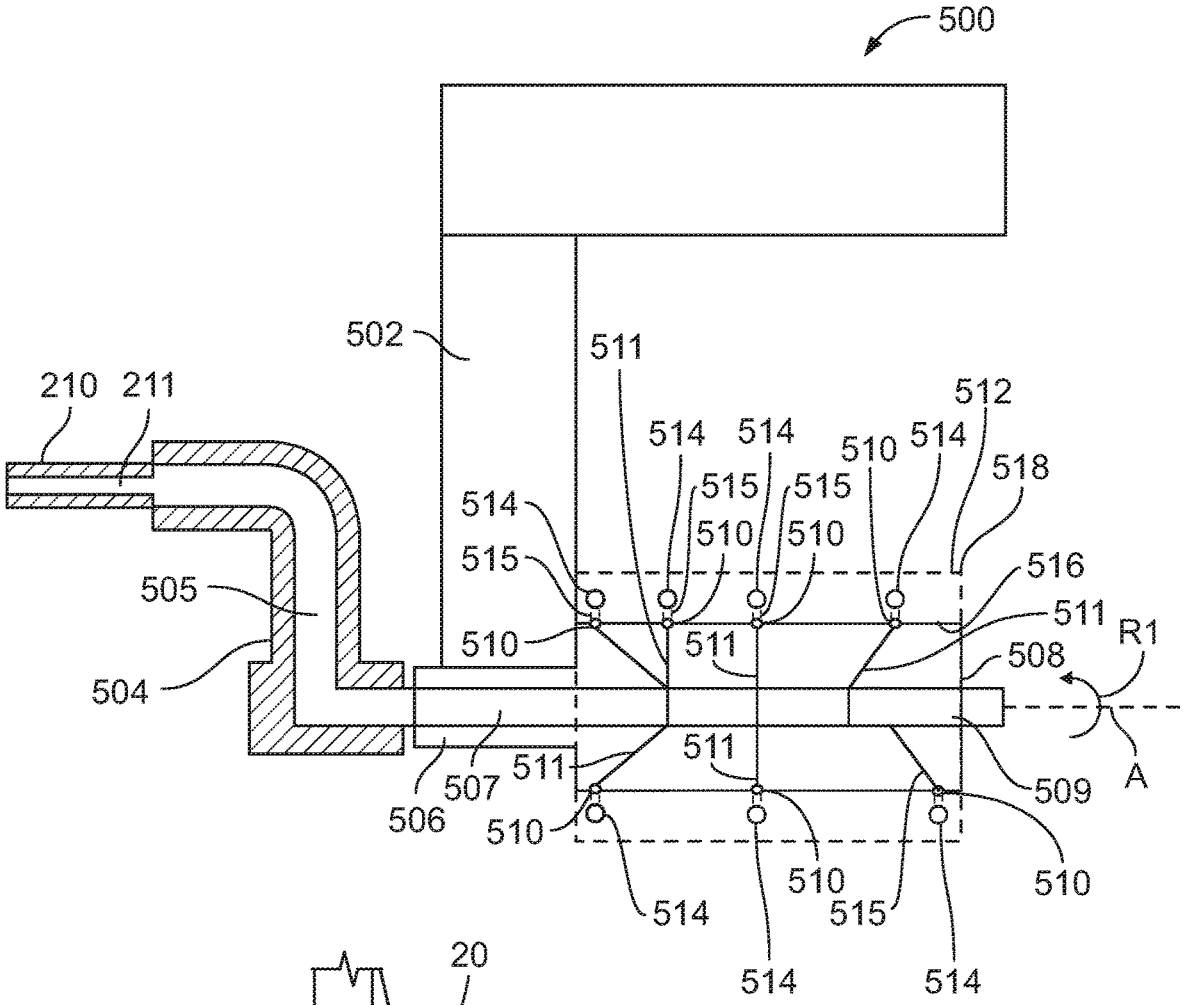
FIG. 3C illustrates a close up cross-sectional view of another embodiment of the fragrance or malodor control agent applicator illustrated in FIG. 3A.
Figure 4:
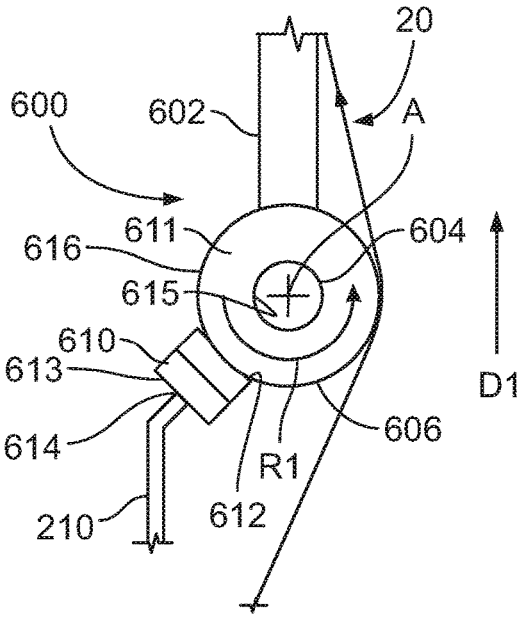
FIG. 4 illustrates a close up view of another embodiment of a fragrance or malodor control agent applicator according to one aspect of the present application that can be used with the system of FIG. 1.

Turning to FIG. 3C illustrating a cross-sectional view of an alternative embodiment of the applicator 500 illustrated in FIG. 3A. As will be understood, the applicator 500 illustrated in FIG. 3C is identical to the applicator 500 illustrated in FIG. 3B with the exception that the two outermost internal cavities 511 that are radially extending through the spindle are extending through the spindle 508 at an angle relative to the first internal cavity 509 of the spindle 508 while the middle external cavities 511 are perpendicularly extending relative to the first internal cavity 509 of the spindle 508. FIG. 4 illustrates another example of an applicator 600 according to one aspect of the present application. The applicator 600 includes a bracket 602 and a spindle 604. The spindle 604 can be made from any material generally known in the art, such as, but not limited to a metal. The spindle is rotatively connected to the bracket 602, such that the spindle 604 can rotate about axis A in direction R1.

According to one aspect of the present application, the fragrance or malodor control agent 21 will be applied to the plastic web 12 by the exterior surface of the spindle 604. The exterior surface of the spindle 604 can be knurled, as illustrated in FIG. 3A, to allow the fragrance or malodor control agent 21 to be evenly distributed about the exterior surface of the spindle 604 for even application of the fragrance or malodor control agent 21.

According to another aspect of the present application, a roller 606 can be slidably connected to the spindle 604 via an interior surface 615 of the roller 606. The exterior surface 616 of the roller 606 is composed of a liquid absorbing material that comes into at least partial contact with a liquid applicator 610.

As discussed above, the liquid absorbing material of roller 606 may be any type of material capable of absorbing liquid that is generally known in the art such, as but, not limited to a wool, a synthetic fabric, a foam, a foam rubber, a polyester fabric, a polyacrylic woven fabric, a structures polyamide and Nylon, a Nylon woven fabric, or a polyacrylic fabric.

The liquid applicator 610 has a first side 612 and a second side 613. The first side 612 of the liquid applicator 610 is at least partially composed of a liquid absorbing material, such as, but not limited to, a sponge or a water absorbing fabric. The second side 613 of the liquid applicator 610 has an inlet 614 that is connected to a tube 210 the extends between the pump 200 and the applicator 600 (see FIG. 4).

As illustrated, the liquid applicator 610 is positioned so that the first side 612 of the liquid applicator 610 composed of the liquid absorbing material comes into at least partial contact with the exterior surface of the spindle 604 or, if a roller 606 is slidably coupled to the spindle 604, the exterior surface 616 of the roller 606 as they rotate in direction R1 about axis A.

In use, the fragrance or malodor control agent 21 is pumped by the pump 200 through tube 210 and into inlet 614 located on the second side 613 of the liquid applicator 610. When enough fragrance or malodor control agent 21 is pumped into the liquid applicator 610 the fragrance or malodor control agent 21 will sufficiently saturate the liquid absorbing material located along the first side 612 of the liquid applicator 610 that come into at least partial contact with the exterior surface of the spindle 604 or the exterior surface 616 of the roller 606.

As the spindle 604 and the roller 606 rotates in direction R1 about axis A the exterior surface of the spindle 604 or the external surface 616 of the roller 612 will come into at least partially contact the first surface 612 of the liquid applicator 610 that is saturated with fragrance or malodor control agent 21. The at least partial contact between the exterior surface of the spindle 604 or the external surface 616 of the roller 612 and the first surface 612 of the saturated liquid applicator 610 causes the fragrance or malodor control agent 21 saturating the first surface 612 of the liquid applicator 610 to be transferred to the exterior surface of the spindle 604 or the exterior surface 616 of the roller 612.

As the plastic web 12 is pulled through the form and seal machine 30 in direction D1 (see FIG. 1) it will come into at least partial contact with the exterior surface of the spindle 604 or the exterior surface 616 of the roller 606 that includes the applied fragrance or malodor control agent 21 that has been transferred from the first surface 612 of the liquid applicator 610.

As also mentioned above, the transfer of force between the plastic web 12 and the spindle 606 or the roller 606 causes the spindle 606 or the spindle 604 and the roller 606 to rotate in direction R1 about axis A. The rotation of the spindle 604 or the spindle 604 and the roller 606 in direction R1 about axis A helps to ensure that sufficient and even fragrance or malodor control agent 21 is being applied each portion of the plastic web 12 that comes into contact with the exterior surface of the spindle 604 or the exterior surface 616 of the roller 606.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A system for applying a fragrance or malodor control agent to a plastic web in a form and seal machine comprising:

a fragrance or malodor control agent application system;

wherein the form and seal machine is adapted to pull the plastic web adjacent to the malodor control agent application system;

the malodor control agent application system comprising a control module connected to a pump, a storage tank for storing the fragrance or malodor control agent and an applicator;

wherein the applicator comprises a spindle having an internal cavity extending through a body of the spindle in a first direction and a plurality of weep holes extending through the body of the spindle in a second direction; wherein at least one weep hole is located at a gravitational bottom of a fluid spreader;

the fluid spreader having a hollow interior capable storing a supply of fragrance or malodor control agent; and wherein one or more bristles extend from the gravitational bottom of the fluid spreader; and wherein the applicator is capable of applying the fragrance or malodor control agent to the plastic web as the plastic web is moved through the form and seal machine.

2. The system of claim 1, wherein the spindle rotatively connected to a bracket.

3. The system of claim 2, wherein a roller is slidably couplable to the spindle.

4. The system of claim 1, wherein the second direction is perpendicular to the first direction.

5. The system of claim 1, wherein the second direction is angled relative to the first direction.

6. The system of claim 2, wherein the bracket has an internal cavity that extends through the bracket and has a first opening on a first side of the bracket and a second opening on a second side of the bracket.

7. The system of claim 6, wherein the first opening is connected to a pipe and the second opening is connected to the spindle.

8. The system of claim 7, wherein the pipe is connected to a first end of a piece of tubing and the second end of the piece of tubing is connected to an outlet of the pump.

9. The system of claim 7, wherein the second opening is fluidly connected to a first internal cavity extending through the spindle in a first direction.

10. The system of claim 9, wherein the spindle includes a second internal cavity that is radially extending between the first internal cavity and an exterior surface of the spindle in a second direction.

11. The system of claim 1, wherein the control module is integrated with the pump.

12. The system of claim 1, wherein the plastic web is formed from a polyethylene or a blend thereof.

13. The system of claim 1, wherein the applicator is a liquid applicator that is fluidly connected to the pump.

14. The system of claim 13, wherein a fluid applicator has a first surface that is composed of a liquid absorbing material that is capable of being sufficiently saturated with fluid or malodor control agent.

15. The system of claim 14, wherein the first surface applies the fragrance or malodor control agent to an exterior surface of the spindle.

16. The system of claim 2, wherein the spindle extends as a cantilevered extension from the bracket.

17. An applicator for applying a fragrance or malodor control agent to a plastic web comprising:

a fluid spreader having a hollow interior capable storing a supply of fragrance or malodor control agent; wherein a bristle is extending from the gravitational bottom of the fluid spreader a weep hole is located at a gravitational bottom of the fluid spreader;

a bracket;

a spindle rotatably connected to the bracket; and the bracket having an internal cavity that extends through the bracket and, wherein the internal cavity comprising a first internal cavity and a second internal cavity and has a first opening that is fluidly connected to a supply of fragrance or malodor control agent and a second opening that is fluidly connected to the first internal cavity that extends through the spindle in a first direction; wherein a second direction is perpendicular relative to the first direction; and wherein the first internal cavity fluidly connected to the second internal cavity radially extending between the first internal cavity and an exterior surface of the spindle.

18. The applicator for applying a fragrance or malodor control agent to a plastic web of claim 17, wherein a second direction is angled relative to the first direction.

19. The applicator for applying a fragrance or malodor control agent to a plastic web of claim 17, wherein the spindle extends from the bracket as a cantilevered extension.

20. The applicator for applying a fragrance or malodor control agent to a plastic web of claim 17, wherein the spindle is rotatable about an axis in a first direction.

21. The applicator for applying a fragrance or malodor control agent to a plastic web of claim 17, wherein a roller is slidably connected to the spindle.

22. The applicator for applying a fragrance or malodor control agent to a plastic web of claim 17, wherein an opening in a roller and the second internal cavity in the spindle are at least partially overlapping as the roller is slidably connected to the spindle.

23. The applicator for applying a fragrance or malodor control agent to a plastic web of claim 21, wherein the roller has an opening along an interior surface of the roller that allows fluid to pass from the interior surface of the roller to an exterior surface of the roller.

24. The applicator for applying a fragrance or malodor control agent to a plastic web of claim 21, wherein the roller has an exterior surface made from a liquid absorbing material.

25. The applicator of claim 17, wherein at least a portion of the exterior surface of the spindle is knurled.

26. The applicator for applying a fragrance or malodor control agent to a plastic web of claim 17, further comprising a liquid applicator is fluidly connected to a pump.

27. The applicator for applying a fragrance or malodor control agent to a plastic web of claim 26, wherein the fluid applicator has a first surface that is composed of a liquid absorbing material that is capable of being sufficiently saturated with fluid or malodor control agent.

28. The applicator for applying a fragrance or malodor control agent to a plastic web of claim 21, wherein an external surface of the roller is at least partially composed of a liquid absorbing material.

* * * * *